United States Patent [19]

Takechi et al.

[11] 4,057,989

[45] Nov. 15, 1977

[54] METHOD FOR LEVELLING A METAL STRIP OR SHEET

[75] Inventors: Hiroshi Takechi; Mitsunobu Abe; Ryoseki Katsutani, all of Kisarazu; Yoshio Saito, Futsu, all of Japan

[73] Assignee: Nippon Steel Corporation, Tokyo, Japan

[21] Appl. No.: 713,043

[22] Filed: Aug. 9, 1976

[30] Foreign Application Priority Data

Aug. 13, 1975 Japan ..... 50-97514

[51] Int. Cl.[2] ..... B21D 1/02; B21B 45/02; C21D 9/46

[52] U.S. Cl. ..... 72/128; 72/160; 72/201; 148/12 R

[58] Field of Search ..... 72/128, 160, 364, 700, 72/200, 201, 202; 148/12 R, 12 A

[56] References Cited

U.S. PATENT DOCUMENTS

| | | | |
|---|---|---|---|
| 2,980,561 | 4/1961 | Ford et al. | 148/12 A |
| 3,130,088 | 4/1964 | Cook | 148/12 R |
| 3,161,225 | 12/1964 | Ward et al. | 148/12 A |
| 3,247,946 | 4/1966 | Klein | 148/12.3 |
| 3,805,571 | 4/1974 | Toda et al. | 72/202 |
| 3,806,376 | 4/1974 | Toda et al. | 148/12 R |

FOREIGN PATENT DOCUMENTS

| | | | |
|---|---|---|---|
| 45-29096 | 9/1970 | Japan | 72/128 |

*Primary Examiner*—E. M. Combs
*Attorney, Agent, or Firm*—Wenderoth, Lind & Ponack

[57] ABSTRACT

A method for levelling a metal strip or sheet in which the metal strip or sheet is subjected to repeated bending by means of a roll arrangement of two or more rolls having a diameter of at least 600 times the thickness of the metal while cooling the metal strip or sheet from at least about 210° C to about 50° C at a cooling rate not lower than a critical cooling rate C as defined by the following formula but not higher than 200° C/sec., $$C = 1.2 + 0.3 \times 10^{-3} \frac{\text{Roll Diameter (mm)}}{\text{Metal Thickness (mm)}}$$

4 Claims, 5 Drawing Figures

METHOD FOR LEVELLING A METAL STRIP OR SHEET

FIELD OF THE INVENTION

The present invention relates to a method for levelling a metal strip or sheet.

BACKGROUND OF THE INVENTION

In recent years, furniture such as lockers and desks have more and more come to be made of metallic materials in order to conserve wood. The metal sheet or strip used for manufacturing such furniture is required to have a high degree of flatness.

Generally, when a metal material is rolled into a strip or sheet, the rolling is done by using rolls, and during such rolling the rolls themselves are often subject to elastic deformation, or subjected to unequal distribution of the rolling force in the direction of the roll length so that the finished metal strip or sheet is not strictly uniform in thickness, and further the thinner portions of the metal sheet or strip rolled in this manner suffer from local metal imperfections such as "center-bucklings" (A, FIG. 1-a) and "wave edges" (B, FIG. 1-b). Metal sheet or strips with these defects will greatly reduce the commercial value of furniture manufactured therefrom, and it is necessary to improve flatness of the metal sheet or strip and eliminate such imperfections.

DESCRIPTION OF THE PRIOR ART

The conventional method for levelling a metal sheet or strip comprises normally repeatedly bending the metal sheet or strip using a leveller having small-diameter rolls. In such a leveller, several small-diameter rolls about 30 mm in diameter are arranged as shown in FIG. 2, and strain is produced in portions of the metal sheet or strip other than the portions in which center-bucklings and wave edges occur during the repeated bending by the rolls so as to straighten the material.

In such case, the small-diameter rolls are essential and without these rolls no satisfactory strain can be produced and thus no satisfactory levelling or straightening can be achieved. However, in metal materials having a large yield point elongation, such as steel and brass, when the levelling is carried out using such small-diameter rolls, so-called "local bucklings" are caused and fine uneven patterns called "leveller marks" appear on the metal surface.

SUMMARY OF THE INVENTION

Therefore, one of the objects of the present invention is to provide a method for levelling a metal sheet or strip which eliminates the above defects of the conventional art, and which assures satisfactory levelling of the metal material without causing the leveller marks.

Thus, the present invention provides a method for levelling a metal strip or sheet in a heat treating furnace or outside the furnace, which is characterized by repeatedly bending the metal strip or sheet by means of a roll arrangement of two or more rolls having a diameter of 600 or more times the thickness of the metal strip or sheet, while lowering continuously or in a series of steps the temperature of the metal strip or sheet which is at a temperature of at least about 210° C down to about 50° C at an average cooling rate not lower than a critical cooling rate C as defined by the following formula but not higher than 200° C/sec.:

$$C = 1.2 + 0.3 \times 10^{-3} \frac{\text{Roll Diameter (mm)}}{\text{Metal Thickness (mm)}}$$

The essential feature of the present invention is that thermal strain is utilized in addition to mechanical strain for the levelling whereas the conventional method utilizes only the mechanical strain, and in the present invention a heat treating furnace such as an ordinary heating furnace, an induction heating furnace or a continuous annealing furnace may be used for the purpose for attaining the temperature of about 210° C.

DETAILED DESCRIPTION OF THE INVENTION

The present invention will be described in more detail with reference to the attached drawings.

Figure 1A:
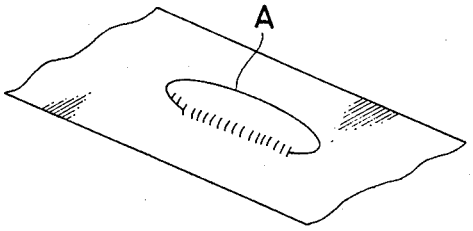
FIGS. 1(*a*) and 1(*b*) are perspective views of a metal strip showing undesirable center-bucklings and wave edges.
Figure 1B:
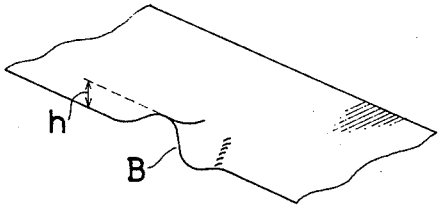
Figure 2:
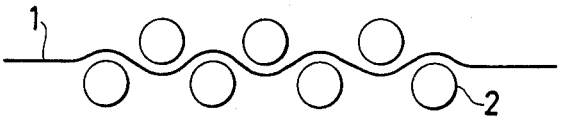
FIG. 2 PRIOR ART
FIG. 2 is a schematic view of a levelling device for carrying out a conventional levelling method.

Regarding the mechanical strain, the conventional levelling art does not give any consideration to prevention of leveller marks and uses small-diameter rolls.

Contrary to the conventional art, the present invention uses two or more rolls having a diameter 600 or more times the metal thickness for the purpose of preventing the leveller marks. With a roll diameter less than 600 times the metal thickness the leveller marks can not be completely prevented. According to the present invention, two or more rolls having such a diameter are provided because bending by only one roll leaves a trend of bending on the metal strip or sheet.

In this connection, it should be noted that the two or more rolls may have different diameters. For example, one may have a diameter of 600 times the metal thickness and the other may have a diameter of 630 times the metal thickness.

When a metal strip or sheet is rapidly cooled from high temperatures, the metal contracts in accordance with its thermal expansion coefficient, and in such case if both ends of the metal strip or sheet are fixed, there is caused a tension stress produced in the metal so that strain is caused and thus a thermal levelling effect is developed. Using this effect, in the present invention it is possible to attain satisfactory levelling even when two or more large-diameter rolls 600 or more times the metal thickness are used. There is no specific upper limit of the roll diameter, but it is preferablly not larger than 3400 times the metal thickness.

In applying the thermal strain, when the metal to be levelled is at a temperature higher than 210° C, a very small strain produced by the large-diameter rolls causes strain ageing and leveller marks tend to appear. Therefore, the present invention should be applied when the metal material is no hotter than about 210° C, e.g. by cooling the metal when the metal is or has been heated beforehand to temperatures higher than 210° C. As for the cooling from about 210° C to about 50° C, a slower cooling rate produces a smaller thermal strain and the desired results of the present invention can not be achieved by a slow cooling below a certain average critical cooling rate.

For satisfactory levelling, it is sufficient that the sum of the mechanical strain and the thermal strain reaches the amount of strain required for the levelling. This means, on the other hand, that if the mechanical strain, which is in inverse proportion to the value obtained by dividing the roll diameter by the metal thickness, is small the thermal strain which is in proportion to the cooling rate must be correspondingly large. Therefore, the critical cooling rate C must be larger in cases where there is a larger value of Roll Diameter/Metal Thickness, and the relation between these factors has been formulated through various experiments as defined in the following equation:

$$C = 1.2 + 0.3 \times 10^{-3} \frac{\text{Roll Diameter (mm)}}{\text{Metal Thickness (mm)}}$$

If the average cooling rate during the cooling from about 210° C to about 50° C exceeds 200° C/sec., uniform cooling is not obtained so that the shape of the metal strip or sheet is damaged.

If the cooling is carried out at an average cooling rate not lower than the critical cooling rate but not higher than 200° C/sec., the cooling may be done continuously or in a series of steps.

The reasons for defining as the lower limit for the temperature range in which the above cooling rate is maintained the temperature of 50° C is that if the rapid cooling is changed to a natural cooling at temperature above 50° C, satisfactory thermal contraction of the metal can not be attained because of the small difference from 210° C.

There are two cases to which the present invention is applied. One case is that in which the metal is initially at higher temperatures than 210° C. In this case, the cooling down to about 210° C may be carried out in an appropriate way without any effect on the present invention. The other case is that in which the metal is initially at a temperature lower than about 210° C. In this case, the metal must be heated to at least about 210° C, although it may be heated to a higher temperature than about 210° C and then cooled.

In both cases, the cooling a the defined cooling rate must be carried out from about 210° C to about 50° C.

Figure 3:
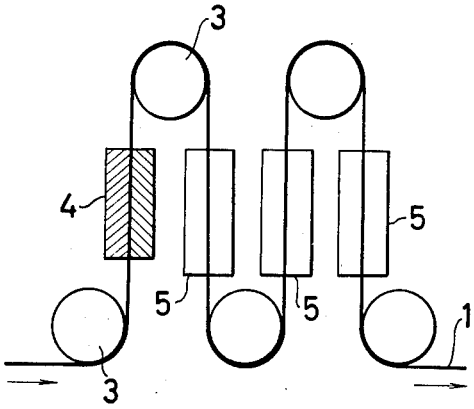
FIG. 3 is a schematic view of one embodiment of an apparatus for carrying out the method of the present invention.

In FIG. 3, which shows an embodiment of the apparatus used in carrying out the method of the present invention, 1 is a metal strip, 3 is a set of large-diameter rolls, 4 is a heater and 5 is a cooler.

In the actual practice of the present invention, the metal strip or sheet may be heated to 210° C specifically for the purpose of levelling as shown in FIG. 3, or it may be heated to temperatures beyond 210° C for other purposes such as heat treatments and then be levelled according to the present invention during its cooling. The levelling effect will not disappear even-after the metal material levelled by the present invention is subjected to skin-pass rolling for tempering.

The present invention is particularly useful for levelling steel sheets having a large yield point elongation with a carbon content not larger than 0.08% and a manganese content not larger than 0.50%. For continuous annealing of these steel sheets, it has been a common practice in the art to provide a continuous annealing furnace, a temper rolling stand and a leveller in the recited order. In this case if the present invention is applied in the final cooling section of the continuous annealing furnace, the conventional leveller may be omitted.

The present invention will be more clearly understood from the following example.

EXAMPLE

Annealed steel sheets having a thickness of 0.6 to 2.4 mm having "wave edges" with a maximum wave height of 5 to 8 mm were heated to 210° C in the apparatus shown in FIG. 3 having rolls of 100, 500, 1000 and 2000 mm diameters, respectively, and cooled to 50° C at the outlet side of the last roll with different average cooling rates ranging from 0.1 to 9.2° C/sec. The steel sheets thus treated were measured for their maximum wave height and inspected for local bucklings.

Figure 4:
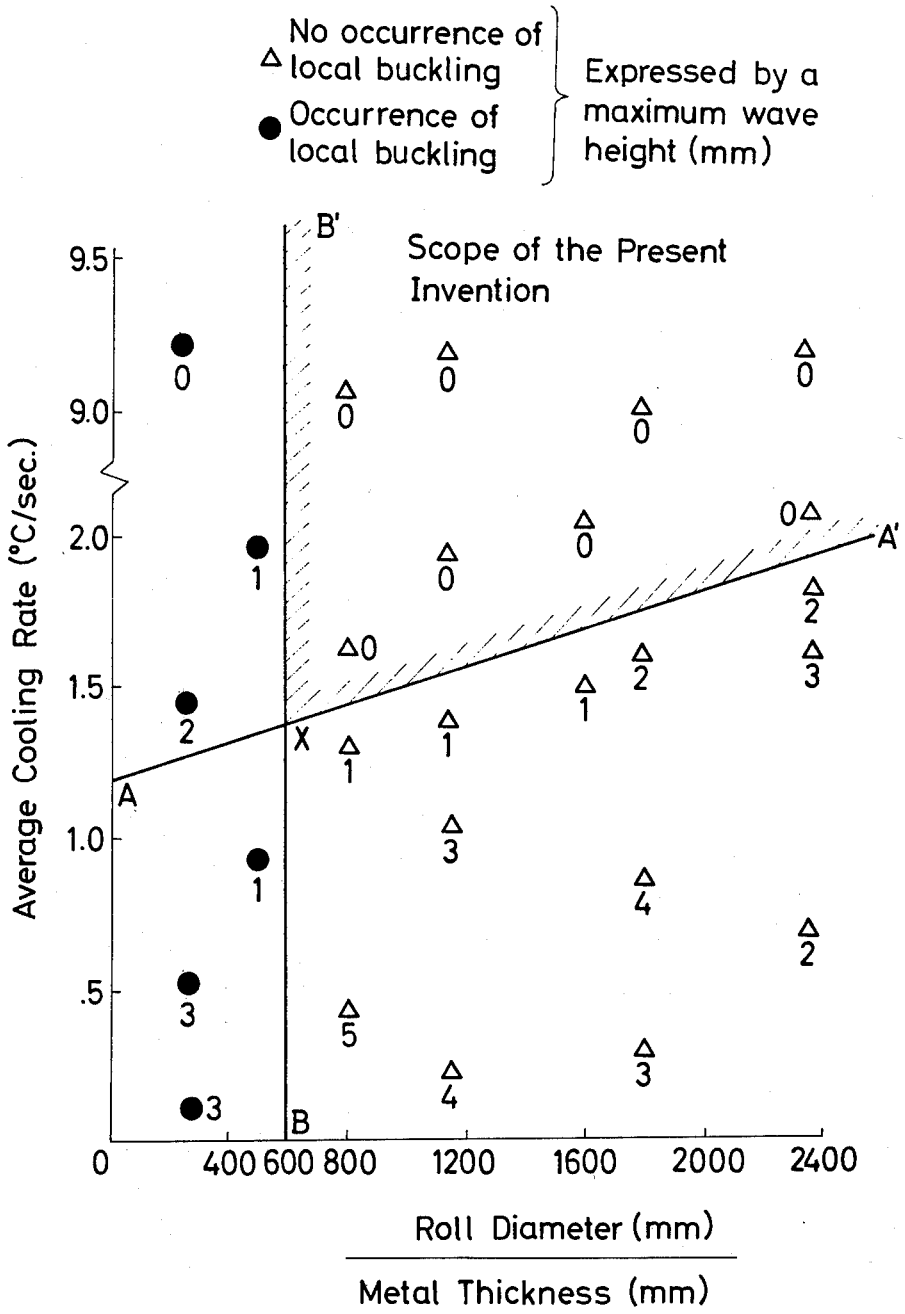
FIG. 4 is a graph showing the relation between the cooling rate and the ratio Roll Diameter/Metal Thickness.

The results are shown in FIG. 4 by which it is clearly shown that in the zone in which the ratio Roll Diameter/Metal Thickness is 600 or higher, namely on the right side of the line B′ × B′ and in the zone in which the cooling rate is not less than $$C = 1.2 + 0.3 \times 10^{-3} \frac{\text{Roll Diameter (mm)}}{\text{Metal Thickness (mm)}}$$

namely on the upper side of the line *x* A′, no local bucklings occur, i.e. the maximum wave height is zero as indicated by the numbers adjacent the symbols.

Thus in the zone defined to the right of the line B′ *x* and above the line *x* A′ no local bucklings occur and the sheets are completely flat and without leveller marks.

What is claimed is:

1. A method for levelling a metal strip or sheet which is at a temperature of about 210° C comprising applying a repeated bending to the heated metal strip or sheet by means of a roll arrangement of two or more rolls each having a diameter of at least 600 times the thickness of the metal while cooling the metal strip or sheet from at least about 210° C to about 50° C at a cooling rate not lower than a critical cooling rate C as defined by the following formula and not higher than 200° C/sec., $$C = 1.2 + 0.3 \times 10^{-3} \frac{\text{Roll Diameter (mm)}}{\text{Metal Thickness (mm)}}.$$

2. A method according to claim 1, in which the repeated bending is applied to the metal strip or sheet which is being cooled between 210° C and 50° C during a final cooling stage after having been heated to a temperature above 210° C for heat treatment and then cooled to about 210° C.

3. A method according to claim 1, in which the repeated bending is applied to the metal strip or sheet which has been reheated from a temperature below 210° C to said temperature of about 210° C.

4. A method according to claim 1, in which the cooling is done continuously.

* * * * *